US008419010B2

(12) United States Patent
Shinagawa et al.

(10) Patent No.: US 8,419,010 B2
(45) Date of Patent: Apr. 16, 2013

(54) DAMPER MEMBER, TRANSPORT UNIT, AND RECORDING UNIT

(75) Inventors: Yu Shinagawa, Shiojiri (JP); Hiroki Chino, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 13/172,155

(22) Filed: Jun. 29, 2011

(65) Prior Publication Data

US 2012/0001381 A1 Jan. 5, 2012

(30) Foreign Application Priority Data

Jun. 30, 2010 (JP) ..... 2010-148756

(51) Int. Cl.
*B65H 3/52* (2006.01)

(52) U.S. Cl.
USPC ..... 271/121; 271/167

(58) Field of Classification Search ..... 271/167, 271/121, 122
See application file for complete search history.

(56) References Cited

U.S. PATENT DOCUMENTS

| | | | | |
|---|---|---|---|---|
| 6,824,132 | B2 | 11/2004 | Asai et al. | |
| 6,984,084 | B2 * | 1/2006 | Ng et al. | 400/624 |
| 7,455,287 | B2 * | 11/2008 | Shiohara et al. | 271/121 |
| 7,828,285 | B2 * | 11/2010 | Chu et al. | 271/167 |
| 8,083,222 | B2 * | 12/2011 | Nakano | 271/121 |
| 8,226,083 | B2 * | 7/2012 | Yanagishita | 271/167 |
| 2004/0245703 | A1 * | 12/2004 | Yun et al. | 271/110 |
| 2004/0251592 | A1 | 12/2004 | Ruhe et al. | |
| 2006/0236331 | A1 | 10/2006 | Ueda et al. | |
| 2011/0156339 | A1 * | 6/2011 | Nakano | 271/4.11 |
| 2011/0292148 | A1 | 12/2011 | Shinagawa et al. | |

FOREIGN PATENT DOCUMENTS

| | | |
|---|---|---|
| JP | 2000-335769 | 12/2000 |
| JP | 2005-008416 | 1/2005 |
| JP | 2006-124131 | 5/2006 |

OTHER PUBLICATIONS

U.S. Appl. No. 13/170,231, filed Jun. 28, 2011, Shinagawa et al.
U.S. Appl. No. 13/170,418, filed Jun. 28, 2011, Shinagawa et al.
U.S. Appl. No. 13/231,538, filed Sep. 13, 2011, Aruga et al.
U.S. Appl. No. 13/170,418, Aug. 10, 2012, Office Action.
U.S. Appl. No. 13/231,538, Sep. 5, 2012, Notice of Allowance.

* cited by examiner

*Primary Examiner* — Kaitlin Joerger
(74) *Attorney, Agent, or Firm* — Workman Nydegger

(57) ABSTRACT

A damper member moves a stopper after a delay in time from a restricting position, at which the stopper restricts the movement of paper, to a releasing position, at which the restriction on the movement is released; the damper member includes a base having a first sliding surface along the paper movement direction and also includes a slider, having a second sliding surface facing the first sliding surface through a viscous material, that slides between a first position at which the stopper is placed at the restricting position and a second position at which the stopper is placed at the releasing position; when at least the slider slides and reaches the first position or the second position, a clearance area is formed in the base to store a viscous material, at a position corresponding to the front end in the sliding direction of the slider.

5 Claims, 9 Drawing Sheets

DAMPER MEMBER, TRANSPORT UNIT, AND RECORDING UNIT

The entire disclosure of Japanese Patent Application No: 2010-148756, filed Jun. 30, 2010 is expressly incorporated by reference herein in its entirety.

BACKGROUND

1. Technical Field

The present invention relates to a recording unit having a damper member.

2. Related Art

As one type of recording unit that causes a liquid (an ink, for example) to adhere to a recording medium (paper, for example) for recording, an ink jet printer (simply referred to below as a printer) is known that ejects an ink from a recording section (a recording head, for example) to paper to record a prescribed image (including characters and figures). To record an image on paper, this type of printer takes out paper from a paper supply cassette (simply referred to below as a cassette), in which a plurality of sheets of paper are stacked, one at a time sequentially from the uppermost sheet. Accordingly, the printer includes an mounting section in which the cassette including a plurality of stacked sheets of paper is mounted so as to be removable by inserting and removing the cassette orthogonally to a direction in which the paper is stacked, and also has a paper feed roller that takes out paper one sheet at a time from the cassette mounted on the mounting section and sequentially feeds the paper to a recording section.

This type of printer has a separating slope at the inner back of the mounting section, in which the cassette is mounted, that is a section opposite to the front end of the cassette mounted in the mounting section in a direction in which the cassette is inserted, the separating slope being used to separate, one sheet at a time, the paper that is taken out of the cassette and is fed by the paper feed roller and to guide the separated paper toward the recording section. When mounting the cassette, the user may insert it into the mounting section at a faster speed. In this case, some stacked sheets may move from the cassette in the insertion direction due to an inertial force and may ride on the separation slope with a rising gradient. This prevents paper sheets from being separated one by one by the separating slope and causes multi-feeding, in which a plurality of stacked sheets are fed together, causing a risk of a paper jam or another problem.

To avoid the above problem, JP-A-2000-335769 describes a shutter member that is lowered from an upper evacuation position to a lower restricting position to restrict the movement of an end of paper, which is on the downstream side in the direction in which the paper is fed in the direction in which the cassette is inserted (the end of the paper in this direction will be referred to below as the front end of the paper). When the shutter member is raised from the lower restricting position, at which the shutter member is brought into contact with the front ends of sheets of paper, to the upper evacuation position, the lower end of the shutter member is rotated toward the upstream of the paper feed direction. This enables the front ends of the sheets of paper with which the shutter member is brought into contact to sequentially match the slop formed downstream in the paper feed direction as the paper is placed on the upper position in the stacking direction.

In JP-A-2000-335769, however, the shutter member is slid to the evacuation position while it is being rotated, so a space is necessary to dispose a rotating mechanism and a sliding mechanism, which are used to have the shutter member carry out the sliding and rotation. Another space is also necessary to accommodate the shutter member, rotating mechanism, and sliding mechanism at the evacuation position. These necessary spaces cause the size of the printer to increase.

A structure has been proposed in view of this situation, in which, for example, a restricting member is included, which has a restricting surface restricting the movement of paper toward the front in the cassette insertion direction, and rotates so as to fall down in the insertion direction. Specifically, the movement of the paper is restricted by the restricting surface to suppress its force, after which a rotational operation is performed after a prescribed delay in time to cause the restricting surface to fall down and evacuate from the separation slope, releasing the paper movement restriction. Therefore, the paper is separated one sheet at a time and guided toward the recording section, without riding on the separation slope. This eliminates the need for a large space in which to accommodate the shutter member, rotating mechanism, and sliding mechanism; only an additional space for a mechanism required for the rotational operation of the restricting member is needed, suppressing the printer from becoming large.

A damper member is used to cause the prescribed delay in time that lasts from when the paper is restricted until the restricting surface falls down in the rotational operation of the restricting member. Specifically, in the rotational operation of the restricting member, the prescribed delay in time is caused by the damper member in which a viscous material is applied between the sliding surfaces of a first member and a second member, which face each other during sliding, the first member and second member relatively moving (sliding) to cause the restricting member to rotate from the restricting position, at which the restricting member restricts the movement of the paper, to a releasing position, at which the restriction is released.

If the viscous material is a fluid such as grease or oil, however, the viscous material, which is applied between the abutting surfaces of the two members, is likely to adhere to areas other than the abutting surfaces of the two members by extending beyond the abutting surfaces and is thereby likely to be lost. This may change a damper force. Furthermore, the damper member may be dirtied by the viscous material that has adhered to the other areas and the printer may also be dirtied.

SUMMARY

An advantage of some aspects of the invention is to provide a recording unit having a damper member for which a change in damper force is suppressed.

A recording unit according to an aspect of the invention includes a restricting member, structured so as to be rotatable around an axial portion, that is brought into contact with a target to restrict the movement of the target, and also has a damper member that causes the restricting member to rotate after a delay in time from a restricting position, at which the restricting member restricts the movement of the target, to a releasing position, at which the restriction on the movement of the target is released; the damper member includes a viscous material, a first member having a first sliding surface in a direction in which the target moves, and a second member having a second sliding surface, which faces the first sliding surface of the first member with the viscous material being applied therebetween, the second member sliding between a first position at which the restricting member is placed at the restricting position and a second position at which the restricting member is placed at the releasing position with the second member engaging the restricting member; when at least the second member slides and reaches one of the first position and the second position, a clearance area is formed in the first member to store the viscous material, at a position corresponding to a front end of the second member in its sliding direction.

Since, in this structure, the viscous material raked out of the second sliding surface toward the front in the sliding direction is stored in the clearance area formed between the first member and the front end of the second member in the sliding direction, the viscous material is held in the vicinity of the second sliding surface. This suppresses the raked-out viscous material from adhering to other portions and being thereby lost, so the viscous material can be stably held between the first sliding surface and the second sliding surface, suppressing a change in damper force. It is also suppressed that the damper member is dirtied by the raked-out viscous material that would otherwise adhere to other portions.

In the recording unit according to the aspect of the invention, an area over which the second sliding surface faces the first sliding face is preferably unchanged while the second member slides between the first position and the second position, and the clearance area preferably has a space enough to store a surplus over an amount by which the viscous material can be held on the second sliding surface.

In this structure, a surplus over the amount of viscous material that can be held between the first sliding surface and the second sliding surface can be stored in the clearance area formed at the front end of the second member in the sliding direction. Therefore, the viscous material is held in the vicinity of the second sliding surface and, in principle, the viscous material does not adhere to other portions, so the viscous material can be stably held between the first sliding surface and the second sliding surface. As a result, a change in dumper force can be suppressed and it is also suppressed that the damper member is dirtied by the raked-out viscous material.

With the recording unit according to the aspect of the invention, the second sliding surface preferably has a cross section, intersecting the sliding direction of the second sliding surface, that is shaped by repeating a concave part and a convex part in a direction intersecting the sliding direction.

This structure enables the total area of the second sliding surface facing the first sliding surface to be enlarged. Therefore, even if the allowable area of the second sliding surface is small in plan view, the second sliding surface can face the first sliding surface in a wide area through the viscous material, enabling the damper force to be increased. The total area can also be adjusted on the basis of the concave and convex shape to be formed, so the damper force of the damper member can also be set to a desired value.

With the recording unit according to the aspect of the invention, a positioning section that locates the second member at the first position or the second position with respect to the first member is preferably formed in an area other than the first member and the second sliding surface of the second member.

This structure prevents the area over which the second sliding surface faces the first sliding surface from changing while the second member slides between the first position and the second position, suppressing a change in damper force.

With the recording unit according to the aspect of the invention, the second member preferably comes closest to the target when the second member is located at the first position, and the clearance area is preferably formed at the front end of the second sliding surface in the sliding direction in which the second member slides to the first position.

In this structure, the clearance area, in which the viscous material is stored, is formed at the end, of the second sliding surface, close to the target, so it is suppressed that the viscous material raked out of the second sliding surface adheres to the target.

BRIEF DESCRIPTION OF THE DRAWINGS

FIG. 4A is a plan view of the damper member, FIG. 4B schematically shows a state at a restricting position, and FIG. 4C schematically shows a state at a releasing position.

FIGS. 6A and 6B are cross sectional views illustrating the structures of damper members, and FIGS. 6C to 6F illustrate behaviors of viscous grease.

DESCRIPTION OF EXEMPLARY EMBODIMENT

An embodiment of a damper member crystallized in a printer, which is used as a recording unit with a transfer unit including the damper member, will be described below with reference to the drawings.

Figure 1:
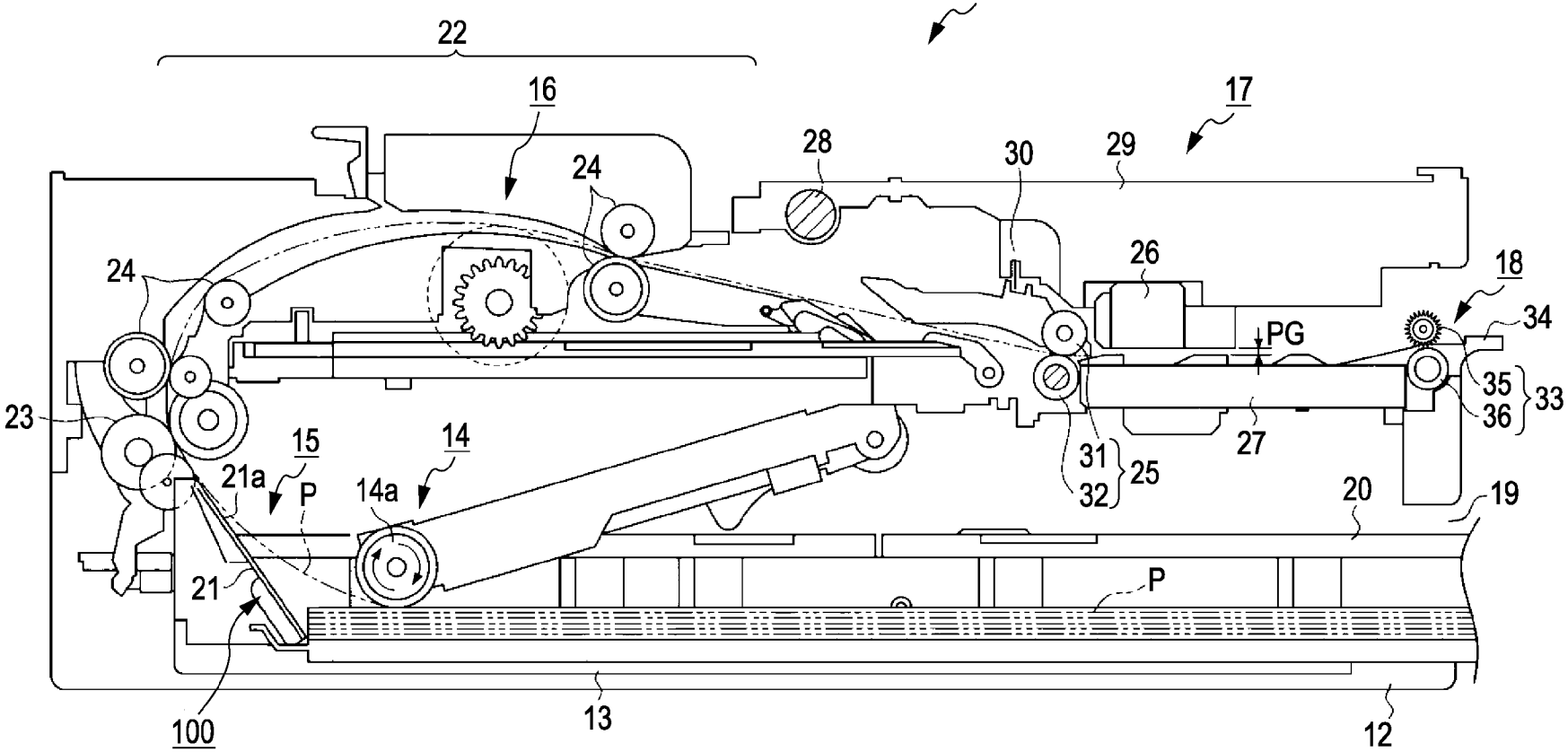
FIG. 1 schematically shows the structure of a printer according to an embodiment.

As shown in FIG. 1, the printer 11 according to this embodiment has an mounting section 13, a feed section 14, a separating section 15, a transport section 16 used as a transporter, a recording section 17 used as a recorder, and an ejection section 18 in a frame 12 having a cabinet-like shape. These components are sequentially disposed along a transport path of paper P, which is a target on which the printer 11 carries out recording.

The mounting section 13 is disposed at the bottom (the lower section in FIG. 1) in the frame 12, and communicates with the outside of the frame 12 through a rectangular insertion port 19, which has an opening in one side (the right side in FIG. 1) of the frame 12. A cassette 20, in which paper P is stacked, can be removably mounted in the mounting section 13 together with the paper P by inserting and removing the cassette 20 through the insertion port 19 in a direction (the horizontal direction in FIG. 1) orthogonal to the direction in which the paper P is stacked.

In the frame 12, the feed section 14 is disposed at a position corresponding to an inner back of the mounting section 13. The feed section 14 has a pickup roller 14*a* that is rotated by the driving force of a feed motor (not shown). Out of the sheets of paper P stacked in the cassette 20 inserted into the mounting section 13 through the insertion port 19, the uppermost sheet of paper P is fed by the rotation of the pickup roller 14*a* in a direction away from the insertion port 19.

In the frame 12, the separating section 15 is disposed at a position opposite to the front end of the cassette 20, inserted into the mounting section 13, in the insertion direction. The separating section 15 has an angled plate 21, which forms a slope with a rising gradient when viewed from the mounting section 13. When the paper P fed from the feed section 14 overstrides a separation slope 21*a* formed by the slope of the angled plate 21 while the end of the paper P is brought into contact with the separation slope 21*a*, the separating section 15 sends paper P one sheet at a time to the transport section 16 disposed downstream.

As shown in FIG. 1, in the frame 12, the transport section 16 is disposed so that a reversal transport path 22, through which the paper P sent from the separating section 15 can be reversed and can be transported to the recording section 17, is formed in the frame 12. A plurality of separation rollers 23 are disposed upstream on the reversal transport path 22, and a plurality of intermediate transport rollers 24 are provided downstream of the separation rollers 23 at intervals on the reversal transport path 22. The separation rollers 23 separate stacked sheets of paper P that have been sent without being separated on the separation slope 21*a*, and reliably send the paper P one sheet at a time toward the downstream at which the intermediate transport rollers 24 are disposed. The intermediate transport rollers 24 each rotate so that the feed direction from the cassette 20 toward the separating section 15 (in FIG. 1, the direction toward the left) is reversed to the reversal transport direction (in FIG. 1 the direction toward the right), and send the paper P to the recording section 17.

The recording section 17, disposed at an upper section in the frame 12 as described above, includes a transport roller pair 25, a recording head 26, and a support member 27 used as a base for the paper P. The recording head 26 is secured to a carriage 29, which can bidirectionally move along a guide axis 28 in the width direction (in FIG. 1, the direction orthogonal to the drawing sheet) of the paper P, the width direction intersecting the transport direction. The carriage 29 is driven by a motor (not shown) so as to be moved in a main scanning direction, which is along the guide axis 28. When a position in the main scanning direction is detected by a position detecting unit (encoder) 30, the driving position of the carriage 29 is controlled.

After the paper P has been sent to the recording section 17 structured as described above, the paper P is transported in a sub-scanning direction, which intersects the main scanning direction, by the rotation of the driving transport roller 32 while being held between a driven transport roller 31 and a driving transport roller 32, the driven transport roller 31 and driving transport roller 32 forming the transport roller pair 25. The paper P is then moved between the recording head 26 and the support member 27. At that time, the paper P is moved while being pressed against the support member 27, and a gap PG is formed between the paper P and the recording head 26. In this state, the recording head 26 moves in the main scanning direction, which is the width direction of the paper P, in synchronization with the movement of the carriage 29. During this movement, a nozzle (not shown) expels ink, as a recording liquid, toward the paper P separated through the gap PG, forming an image. The paper P, on which the image has been formed, is then sent to the ejection section 18.

The ejection section 18 includes an ejection roller pair 33 and an ejection stacker 34. The paper P is transported toward the downstream in the transportation direction (in FIG. 1, to the right) by the rotation of a driving ejection roller 36, while being held between the driving ejection roller 36 and a driven ejection roller 35 formed with a gear and, the driven ejection roller 35 and driving ejection roller 36 forming the ejection roller pair 33. The paper P is then ejected to the ejection stacker 34. The printer 11 prints a prescribed image on the paper P in this way.

As shown in FIG. 1, the printer 11 according to the embodiment further includes a damper member 100 at a place where to receive the paper P that has been sent from the cassette 20 to the separating section 15 by the rotation of the pickup roller 14*a* and is then sent to the transport section 16 while being separated through the separation slope 21*a* one sheet at a time. The damper member 100 and transport section 16 constitute a transportation unit that stably supplies the paper P to the recording section 17 one sheet at a time. The damper member 100 in the embodiment will be described with reference to the drawings.

Figure 2:
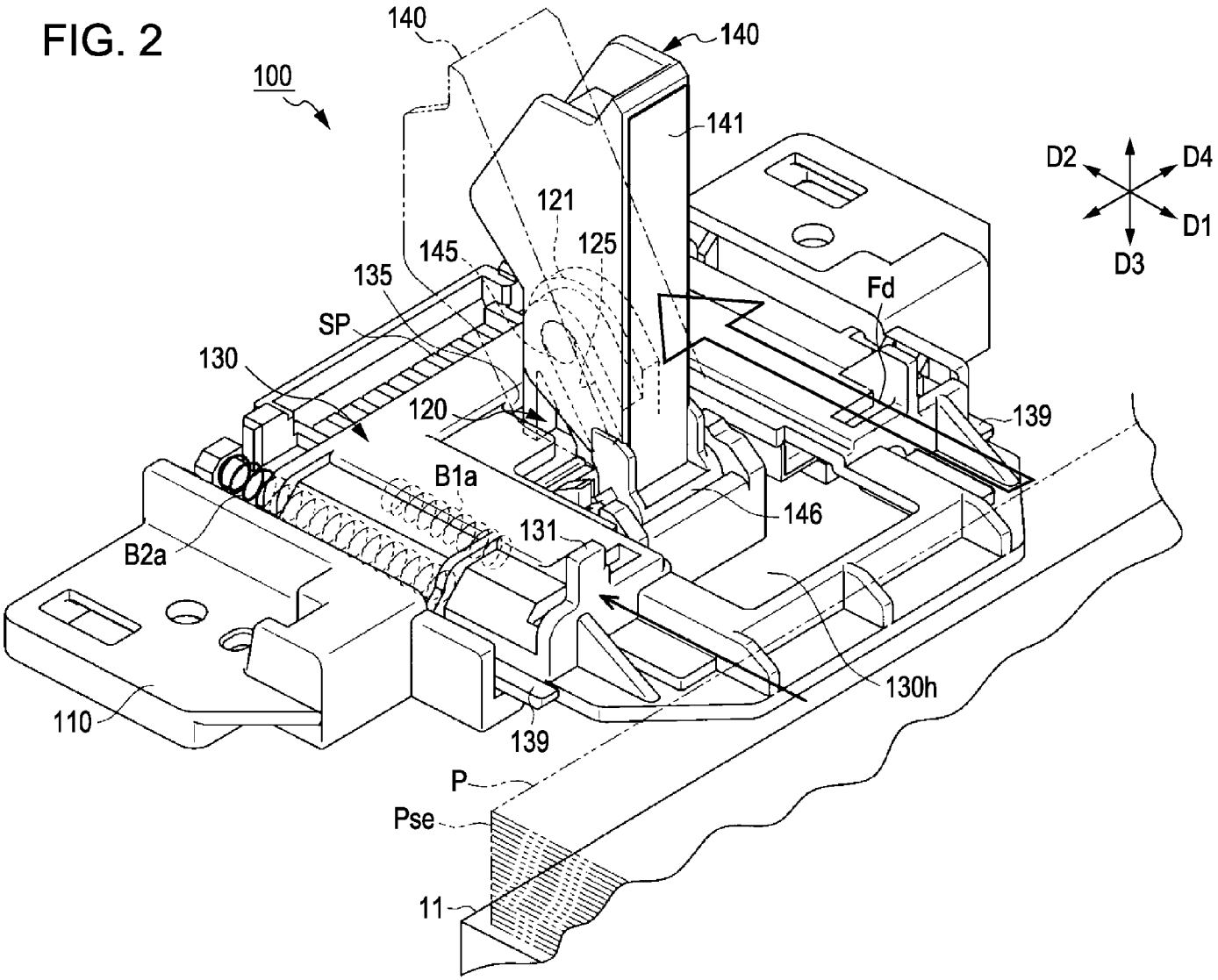
FIG. 2 is a perspective view illustrating the structure of a damper member in the embodiment.

FIG. 2 is a perspective view illustrating the structure of the damper member 100 in the embodiment, in which the cassette 20 is not yet mounted in the mounting section 13. As shown in the drawing, the damper member 100 includes a base 110, which is a first member, a slider 120, which is a second member, a slider cassette 130, and a stopper 140, which is a restricting member for restricting the movement of the paper P. To make the description below easy to understand, the direction in which the cassette 20 is removed will be denoted D1, the direction in which it is inserted will be denoted D2, the direction that is orthogonal to the insertion direction and removal direction and is the same direction as the thickness direction of the paper P will be denoted D3, and the direction that is orthogonal to the insertion direction and removal direction and is the same direction in the width direction of the paper P will be denoted D4.

Figure 3:
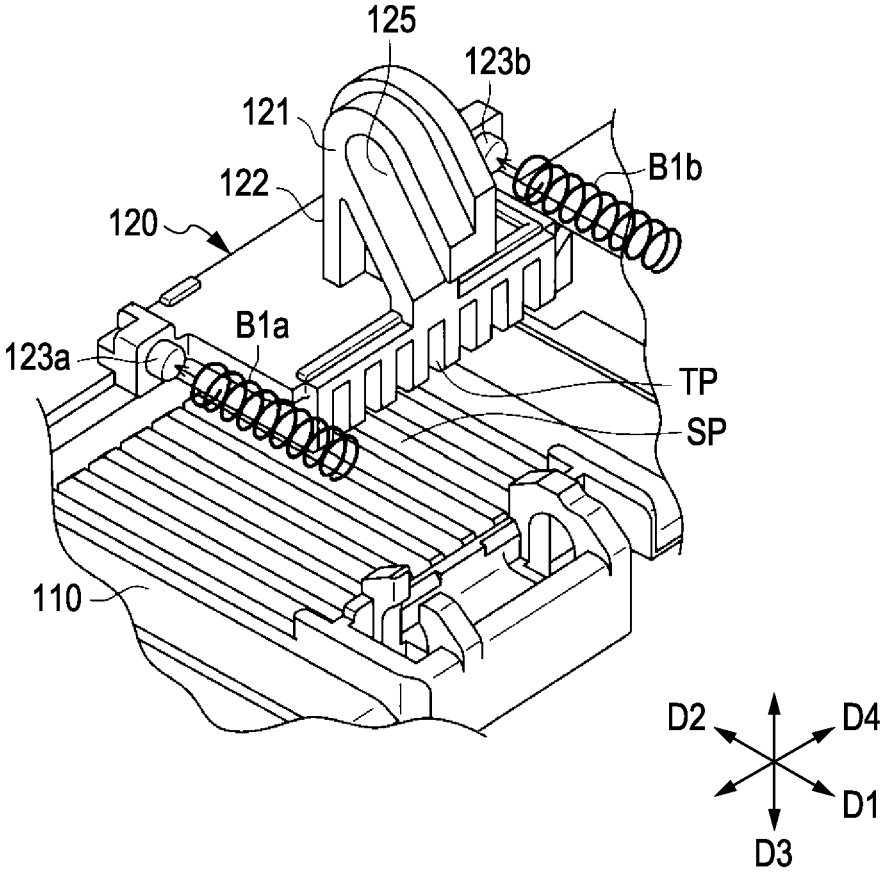
FIG. 3 is an exploded perspective view illustrating the damper mechanism of the damper member in the embodiment.

The base 110 is secured to the frame 12 of the printer 11. A first sliding surface SP over which the slider 120 slides is formed at the center of the base 110 in the width direction D4 of the paper P. In the embodiment, the slider 120 slides in the removal direction D1 and insertion direction D2 of the cassette 20. The first sliding surface SP and the slider 120 will be first described with reference to FIG. 3. FIG. 3 is a perspective view in which the slider cassette 130, described later, and the stopper 140 are removed and the slider 120 is separated from the base 110.

As shown in the drawing, the first sliding surface SP formed on the base 110 has a so-called comb shape, in which a concave part and a convex part are repeated in the width direction D4 intersecting the sliding direction (removal direction D1 or insertion direction D2), in a cross section intersecting the sliding direction. Since a plurality of convex strings are formed so that their longitudinal directions are mutually parallel in the insertion direction D2, the first sliding surface SP with a plane area is formed, the plane area being substantially rectangular in plan view in the thickness direction D3.

The slider 120 has a second sliding surface TP formed so as to face the concave and convex shape of the first sliding surface SP with a prescribed interval left therebetween through viscous grease, which is a viscous material. That is, the second sliding surface TP has a so-called comb shape, in which a concave part and a convex part are repeated, so as to face the concave and convex shape of the first sliding surface SP over substantially the same range as on the first sliding surface SP in the width direction D4 with a clearance left therebetween. In each concave and convex pattern of the second sliding surface TP, the plurality of convex threads are shorter in the longitudinal direction than the concave and convex shape of the first sliding surface SP. Therefore, the second sliding surface TP has a plane area that is substantially rectangular when viewed from the bottom in the thickness direction D3 and has a shorter length in the insertion direction D2 than the first sliding surface SP.

The slider 120 is moved on the first sliding surface SP of the base 110 with viscous grease applied between the first sliding surface SP and the second sliding surface TP by being urged by a pair of coil springs B1*a* and B1*b*, used as urging elements, in the insertion direction D2. The coil springs B1*a* and B1*b* are disposed with the second sliding surface TP being placed therebetween in plan view in the thickness direction D3, at positions at which the coil springs B1*a* and B1*b* do not overlap each other in a plane. One ends of the coil springs B1*a* and B1*b* are supported by or fixed to spring supports 123*a* and 123*b* provided on the slider 120.

A projection 121 having a so-called hooked shape is formed on a surface of the slider 120 opposite to the surface on which the second sliding surface TP is formed. The projection 121 has an engaging space 125 with a prescribed width; the engaging space 125, which is a slit-like space, communicates in the width direction D4, has an open end in the removal direction D1, and is angled so that a falling gradient is formed in the removal direction D1. An engaging pin 145, described later, of the stopper 140 engages the engaging space 125, as shown in FIG. 2.

Referring again to FIG. 2, the slider cassette 130 engages the base 110 at its two ends 139 in the width direction D4, and bidirectionally moves in the insertion direction D2 while the engaged state is maintained. The slider cassette 130 is always urged in the removal direction D1 by a pair of coil springs B2*a* and B2*b* (see FIG. 4A).

The coil springs B2*a* and B2*b* are compression springs, one end of which is supported by or secured to the base 110 and the other end of which is supported by or secured to the slider cassette 130. The coil springs B2*a* and B2*b* are disposed in the vicinity of the two ends in the width direction D4, where the coil springs B2*a* and B2*b* do not overlap the coil springs B1*a* and B1*b* in a plane, in plan view in the thickness direction D3. The other ends of the coil springs B1*a* and B1*b*, the one ends of which are fixed by the spring supports 123*a* and 123*b* of the slider 120, are supported by or secured to spring supports (of these, only a spring support 130*b* on one side is shown in FIGS. 4B and 4C) provided on the slider cassette 130 so as to face the spring supports 123*a* and 123*b* of the slider 120.

The slider cassette 130 has an opening 130*h* at the center in the thickness direction D3, in plan view. The projection 121 of the slider 120 is positioned in the opening 130*h*. The opening 130*h* has an opening circumference 135 in the insertion direction D2 so that when the slider 120 moves in the insertion direction D2, the opening circumference 135 is brought into contact with an engaging section 122, which is part of the projection 121 of the slider 120. Accordingly, the slider cassette 130 restricts the movement of the slider 120 in the insertion direction D2 with the opening circumference 135 of the opening 130*h*.

The slider cassette 130 has abutting sections 131 with which the end of the cassette 20 inserted into the printer 11 in the insertion direction D2 is brought into contact when the cassette 20 is moved as indicated by the bold arrow in FIG. 2. In the slider cassette 130 in the embodiment, the other ends of the coil springs B2*a* and B2*b* and the coil springs B1*a* and B1*b* are supported by or secured to a surface that is substantially at the same positions as the abutting sections 131 and is opposite to the surface with which the cassette 20 is brought into contact.

As shown in FIG. 2, the stopper 140 has a restricting surface 141, which is substantially planar and is oriented in a direction opposite to the insertion direction D2. The restricting surface 141 is disposed so that it faces a direction intersecting the separation slope 21*a* (the thickness direction D3 orthogonal to the insertion direction D2) at a position where the movement of the paper P is restricted (the position will be referred to as the restricting position). The stopper 140 has a rotational axis section 146 at an end in the thickness direction D3; the stopper 140 is attached to the base 110 so that the restricting surface 141 is rotatable around the rotational axis section 146 used as a fulcrum. The stopper 140 also has a pair of walls extending in parallel from both ends in the width direction D4 toward a direction away from the restricting surface 141. A cylindrical engaging pin 145, the axial direction of which extends in the width direction D4, is supported between this pair of walls. The engaging pin 145 engages the engaging space 125 disposed in the projection 121 of the slider 120 described above and forms a so-called cam mechanism. The cam mechanism enables the restricting surface 141 of the stopper 140 to rotate around the rotational axis section 146 at the end together with the movement of the slider 120 in the insertion direction D2, causing the end of the restricting surface 141 to incline in the insertion direction D2. This inclination of the restricting surface 141 is larger than the inclination of the separation slope 21*a*.

The damper member 100 structured in this way receives and stops an inertial force Fd (indicated by the hollow bold arrow in FIG. 2) of the paper P on the restricting surface 141, the inertial force being caused when a plurality of sheets of paper P stacked in the cassette 20 inserted in the insertion direction D2 move in the insertion direction D2. This restricts a side end surface Pse of the stacked sheets of paper P in the insertion direction D2. To release the restriction on the movement of the paper P in the insertion direction D2 with a delay in time, the stopper 140 is then operated so that its restricting surface 141 is inclined in the insertion direction D2 to a position at which the inclination is larger than the inclination of the separation slope 21*a* (the position is referred to as the restricting position). The operation in which the stopper 140 inclines with a delay of time will be described with reference to FIGS. 4A to 4C.

Figure 4A:
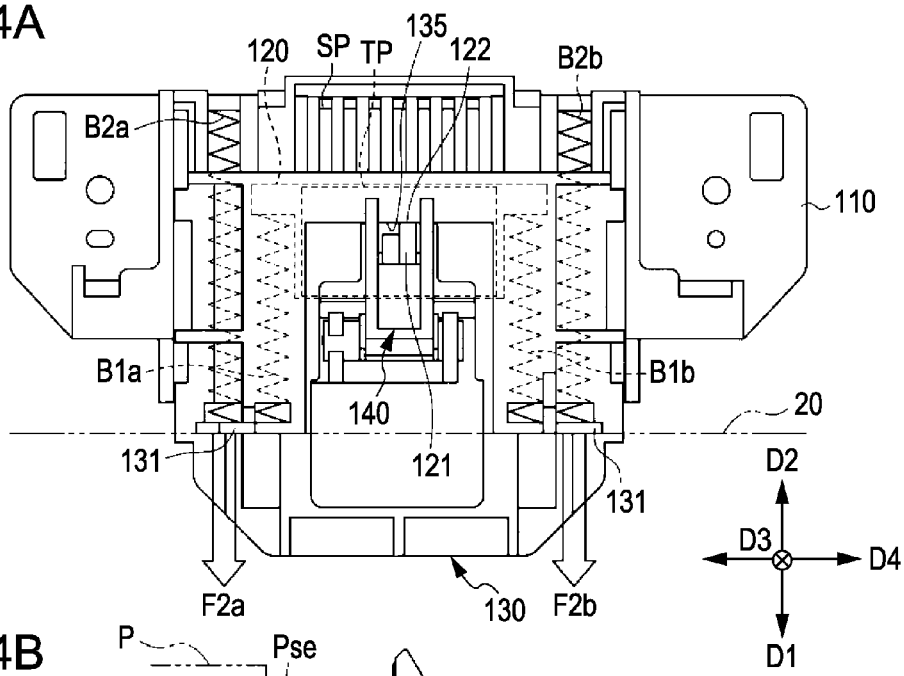
FIGS. 4A to 4C illustrate the operation of the damper member.
Figure 4B:
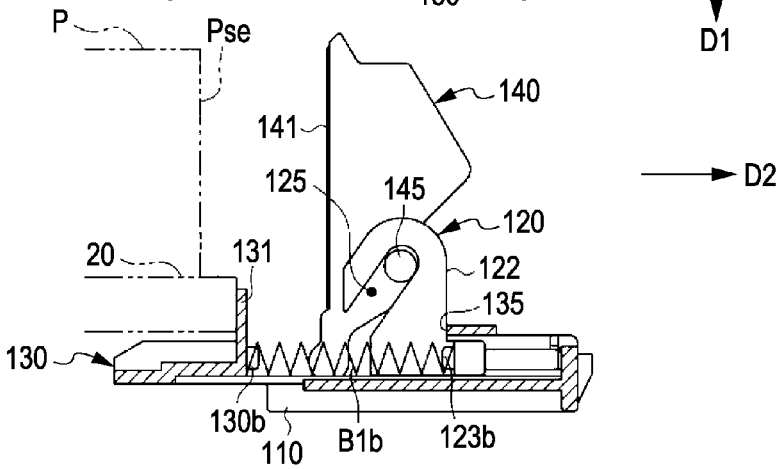
Figure 4C:
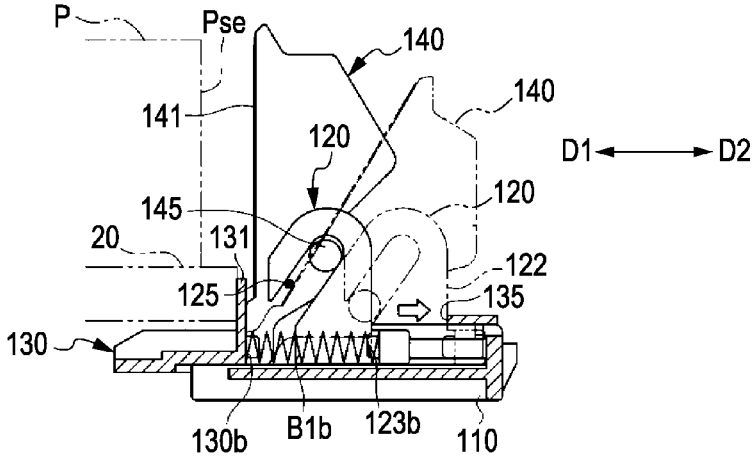

FIG. 4A is a plan view in the thickness direction D3 that schematically shows the damper member 100 with the cassette 20 not mounted in the mounting section 13. FIG. 4B schematically shows the damper member 100 in FIG. 4A, when viewed from the width direction D4. FIG. 4C schematically shows the damper member 100 with the cassette 20 mounted, when viewed from the width direction D4. To make the description below easy to understand, components in FIGS. 4B and 4C are shown as cross sections, as necessary.

As shown in FIGS. 4A and 4B, in a non-mounted state, which continues until the cassette 20 comes in contact with the abutting section 131 of the slider cassette 130, the slider cassette 130 is urged in the removal direction D1 by spring forces F2*a* and F2*b* of the coil springs B2*a* and B2*b*. Therefore, since the opening circumference 135 of the opening 130*h* presses the engaging section 122 of the projection 121 on the slider 120 in the removal direction D1, the slider cassette 130 restricts the movement of the slider 120 so that it does not move in the insertion direction D2. At that time, to prevent the slider 120 from moving in the removal direction D1, it is positioned by being brought into contact with a counter abutting section 128 (see FIG. 7A), the counter abutting section 128 being formed in the removal direction D1 with respect to an abutting section 118 (see FIG. 7A) provided on the base 110. Since the opening circumference 135 of the slider cassette 130 and the abutting section 118 on the base 110 function as a positioning section in this way, the slider 120 is held at a first position, by which the restricting surface 141 of the stopper 140 is maintained at the restricting position (at which the stopper 140 stands as indicated by the solid lines in FIG. 2) at which the stopper 140 restricts the movement of the paper P.

In the embodiment, when the slider 120 is held at the first position, the coil springs B1*a* and B1*b* are slightly compressed. This enables the coil springs B1*a* and B1*b* to continue to be stably secured between the slider 120 and the slider cassette 130.

When the cassette 20 is mounted, the abutting section 131 of the slider cassette 130 is pressed by the cassette 20 and the slider cassette 130 moves in the insertion direction D2. Accordingly, as shown in FIG. 4C, the opening circumference 135, which has been restricting the movement of the slider 120, moves in the insertion direction D2 and is separated from the slider 120 (specifically, the engaging section 122, which is the back (surface in the insertion direction D2) of the projection 121). At that time, the coil springs B1*a* and B1*b* are compressed by the movement of the slider cassette 130. The compressed coil springs B1*a* and B1*b* give the slider 120 a force with which the slider 120 moves in the insertion direction D2. As a result, the slider 120 moves in the insertion direction D2 as indicated by the dash-dot-dot lines in FIG. 4C, so the end of the stopper 140 inclines in the insertion direction D2 due to the action of the cam mechanism formed by the engaging pin 145 and engaging space 125 as indicated by the dash-dot-dot lines in the drawing. Then, the stopper 140 is located at the releasing position (at which the stopper 140 is inclined as indicated by the dash-dot-dot lines in FIG. 2) at which the stopper 140 releases the restriction on the movement of the paper P.

The slider 120 is positioned by being brought into contact with a counter abutting section 129 (see FIG. 7A), the counter abutting section 129 being formed in the insertion direction D2 with respect to an abutting section 119 (see FIG. 7A) provided on the base 110, allowing the slider 120 to move up to a predetermined position in the insertion direction D2. Since the abutting section 119 on the base 110 function as a positioning section in this way, the slider 120 is held at a second position, by which the restricting surface 141 of the stopper 140 is maintained at a releasing position at which the stopper 140 releases the restriction on the movement of the paper P.

When the cassette 20 is removed from the mounting section 13, the slider cassette 130 is pushed and moved in the removal direction D1 by the force urged by the coil springs B2*a* and B2*b*, returning the slider 120 from the second position to the first position. That is, when the slider cassette 130 starts to move, its opening circumference 135 comes into contact with the engaging section 122 of the slider 120. The slider cassette 130 is then moved by the force urged by the coil springs B2*a* and B2*b* while the contact state is held, so the slider 120 is moved in the removal direction D1. As a result, the slider 120 is returned from the second position to the position before the cassette 20 has been mounted, that is, the first position. The stopper 140 is rotated by the cam mechanism in synchronization with the return of the slider 120 from the second position to the first position. This restores the restricting surface 141 in the inclined state to the original state, that is, returns the restricting surface 141 from the releasing position to the restricting position.

Figure 5A:
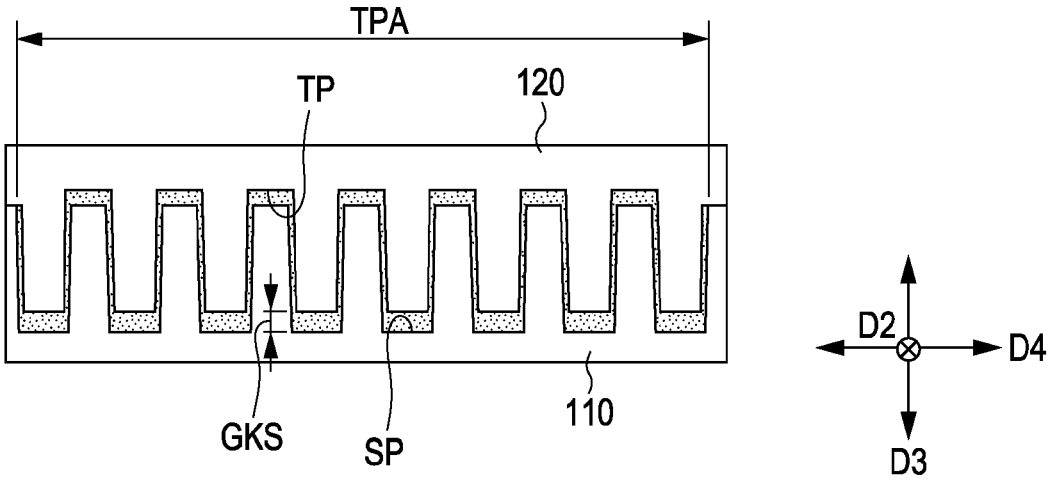
FIG. 5A is a cross sectional view of the shapes of sliding surfaces.
Figure 5B:
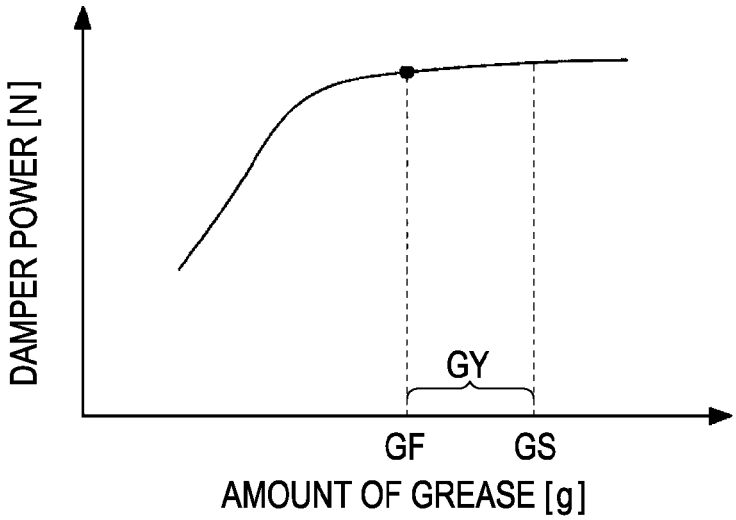
FIG. 5B is a graph illustrating a relationship between the amount of viscous grease and damper force.

In the movement of the slider 120 from the first position to the second position, the second sliding surface TP of the slider 120, shown in FIG. 4A, moves on the first sliding surface SP of the base 110 in the insertion direction D2. A damper mechanism is formed to delay the movement of the second sliding surface TP of the slider 120 by applying viscous grease used as a viscous material between the first sliding surface SP and the second sliding surface TP of the slider 120 as described above, both of which have a concave and convex shape. The damper mechanism will be described with reference to FIGS. 5A and 5B. FIG. 5A schematically shows the cross sections of the first sliding surface SP and second sliding surface TP when viewed from the removal direction D1. FIG. 5B is a graph illustrating a relationship between the amount of viscous grease and damper force.

As shown in FIG. 5A, the first sliding surface SP of the base 110 and the second sliding surface TP of the slider 120 each have a concave and convex shape over an area width TPA within which the these surfaces face each other in the width direction D4, these surfaces being separated by a predetermined distance. When a total separating space GKS formed by the distance is filled with grease, a maximum damper force can be obtained. Specifically, the damper force (N) is increased as the amount of grease (g) increases, as shown in FIG. 5B. When the amount of grease applied to the first sliding surface SP reaches GF, by which the total separating space GKS is filled with grease, an almost maximum damper force is obtained.

As shown in FIG. 4A, the concave and convex shape of the first sliding surface SP is formed over the movement range of the second sliding surface TP in the insertion direction D2, that is, from the first position to the second position. Therefore, the first sliding surface SP has an area larger than the second sliding surface TP. The opposing area of the first sliding surface SP and second sliding surface TP is fixed while the slider 120 slides between the first position and the second position. Therefore, in the embodiment, as shown in FIG. 5B, viscous grease is applied to the first sliding surface SP by an amount GS, which is larger than the amount GF with which the total separating space GKS between the first sliding surface SP and the second sliding surface TP is filled in the state in which the two sliding surfaces SP and TP face each other. Thereby, when the second sliding surface TP slides over the first sliding surface SP having a surplus amount of grease GY, the space between the first sliding surface SP and the second sliding surface TP is highly likely to be always filled with viscous grease in a stable manner.

When a surplus amount of viscous grease is applied to the first sliding surface SP in this way, however, the surplus viscous grease is raked out by the movement of the slider 120. Therefore, it is necessary to prevent the viscous grease raked out of the first sliding surface SP from adhering to other portions. This is because if the viscous grease adheres to other portions and is lessened, the second sliding surface TP, which moves over the first sliding surface SP, produces less damper force due to the inability to fill the space between the first sliding surface SP and the second sliding surface TP with the viscous grease. When this happens, the slider 120 moves faster and the delay in time set for the movement of the stopper 140 is eliminated. This may make the restriction on the movement of the paper P inadequate.

Figure 6A:
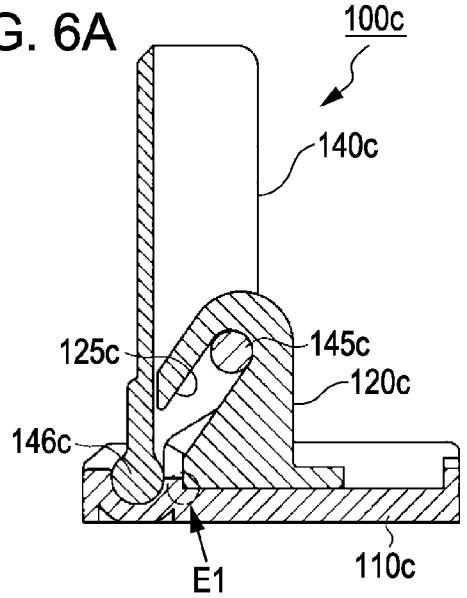
FIGS. 6A to 6F are comparative examples.
Figure 6B:
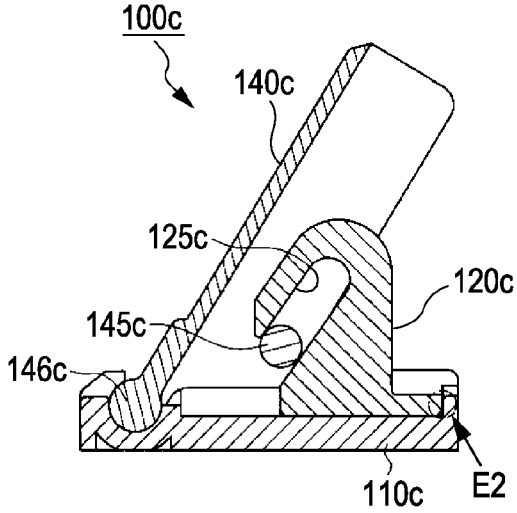

A comparative example for the embodiment will be described with reference to FIGS. 6A to 6F, in which a damper member that easily causes reduction in the amount of viscous grease as described above. FIG. 6A is a cross section of a damper member 100*c* in a plane orthogonal to the width direction D4 when the cassette 20 is not mounted and a slider 120*c* is at the first position. FIG. 6B is a cross section of the damper member 100*c* in a plane orthogonal to the width direction D4 when the cassette 20 has been mounted and the slider 120*c* is at the second position. FIGS. 6C to 6F schematically illustrate the behavior of the viscous grease in the damper member 100*c* when the slider 120*c* slides over a base 110*c*. In FIGS. 6A and 6B, the slider cassette is omitted. Components having the same functions as in the damper member 100 in the embodiment are denoted by the same reference numerals followed by the letter c, and their description will be omitted.

As shown in FIGS. 6A and 6B, the damper member 100*c* is structured so that when a stopper 140*c* is at the restricting position, at which the stopper 140*c* restricts the movement of the paper P, the end of the slider 120*c* in the movement direction is directly brought into contact with the base 110*c* in the area indicated by the arrow E1 in FIG. 6A. When the stopper 140*c* is at the releasing position, at which the stopper 140*c* releases the restriction on the movement of the paper P, the end of the slider 120*c* in the movement direction is directly brought into contact with the base 110*c* in the area indicated by the arrow E2 in FIG. 6A. Therefore, viscous grease G repeats the behavior illustrated in FIGS. 6C to 6F in the range between these contacts.

Figure 6C:
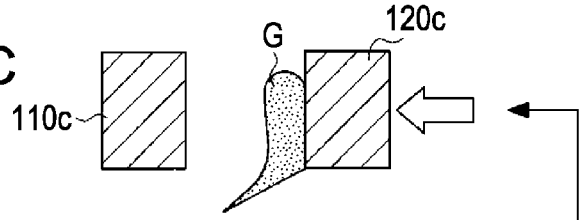
Figure 6D:
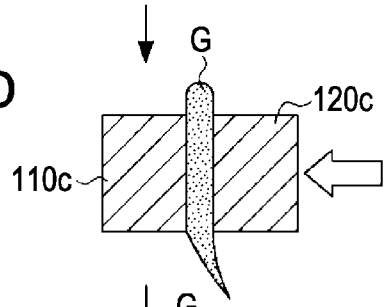
Figure 6E:
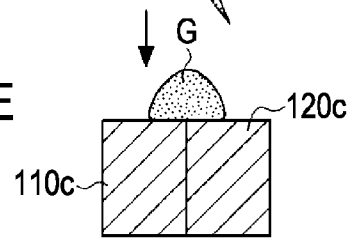
Figure 6F:
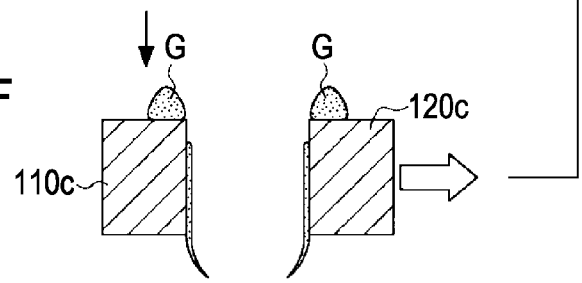

Specifically, as shown in FIG. 6C, raked-out grease G is left more than a little at the top of the end of the moving (sliding) slider 120*c* in the movement direction (indicated by the hollow arrow in the drawing). When the slider 120*c* in this state is brought into contact with the base 110*c*, as shown in FIG. 6D, the viscous grease G left at the top is pressed between the base 110*c* and the slider 120*c* and spreads. The spread viscous grease G is extruded to, for example, a surface other than the first sliding surface SP and adheres to, for example, a surface of the base 110*c* (in the drawing, the upper surface), as shown in FIG. 6E. Then, even when the slider 120*c* moves away from the base 110*c*, the viscous grease G adhering to the surface is left on the surface without being returned to the first sliding surface SP, as shown in FIG. 6F.

With the damper member 100*c* in the comparative example, therefore, the amount of grease applied to the first sliding surface SP is reduced, so the damper force is reduced. The viscous grease that has adhered to a surface other than the first sliding surface SP may further spread to other portions of the damper member 100*c*, and may adhere to other portions. Therefore, it could be considered that the paper P is dirtied or other problems arise.

Figure 7A:
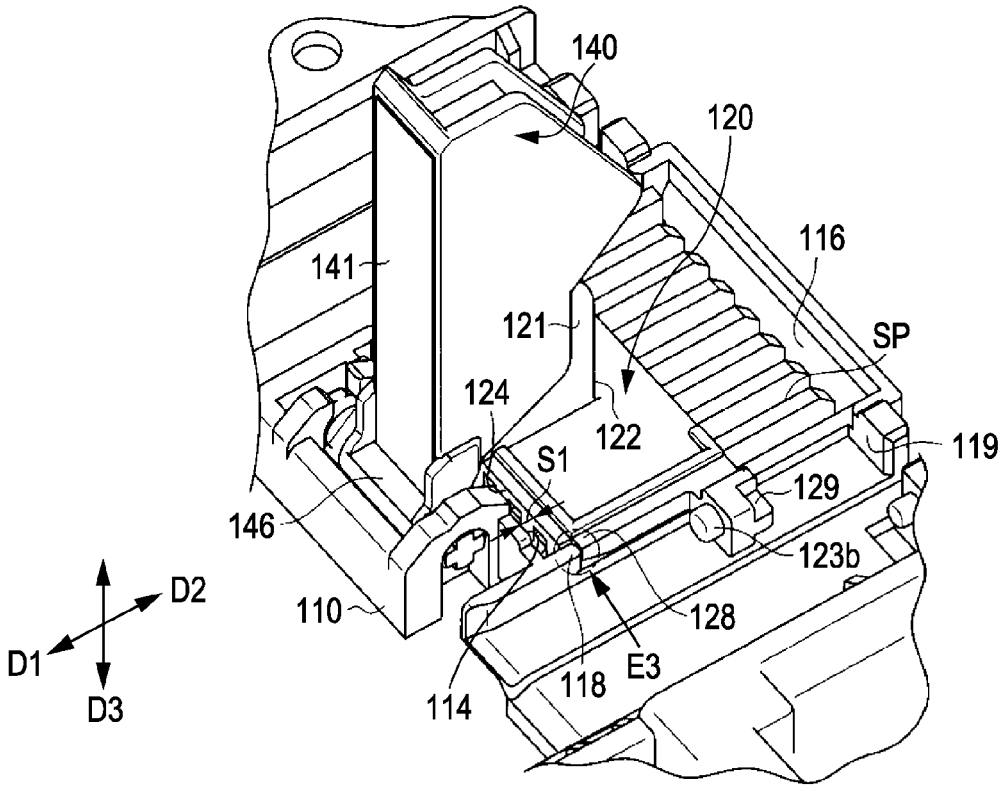
FIG. 7A is a perspective view of the damper member in the embodiment that illustrates a space, formed at the restricting position, in which viscous grease is stored.
Figure 7B:
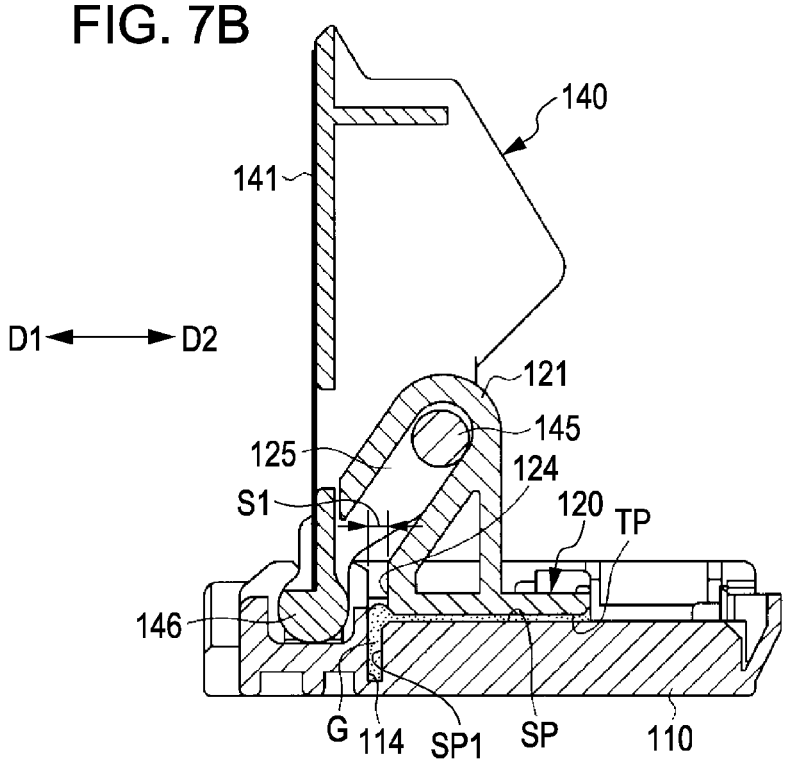
FIG. 7B is a cross sectional view of the damper member.

In view of the above situation, the damper member 100 in the embodiment is structured so that when the cassette 20 is removed from the mounting section 13 and the slider 120 moves from the second position to the first position, a clearance area is formed between the base 110 and the front of the end of the slider 120 in the movement direction, as described below with reference to FIGS. 7A and 7B. When the slider 120 moves from the first position to the second position and the stopper 140 is located at the position at which the stopper 140 releases the restriction on the movement of the paper P, a clearance area is also formed between the base 110 and the front of the end of the slider 120 in the movement direction, as described below with reference to FIGS. 8A and 8B. In FIGS. 7A, 7B, 8A and 8B, the slider cassette 130 is removed to simplify the description.

Figure 8A:
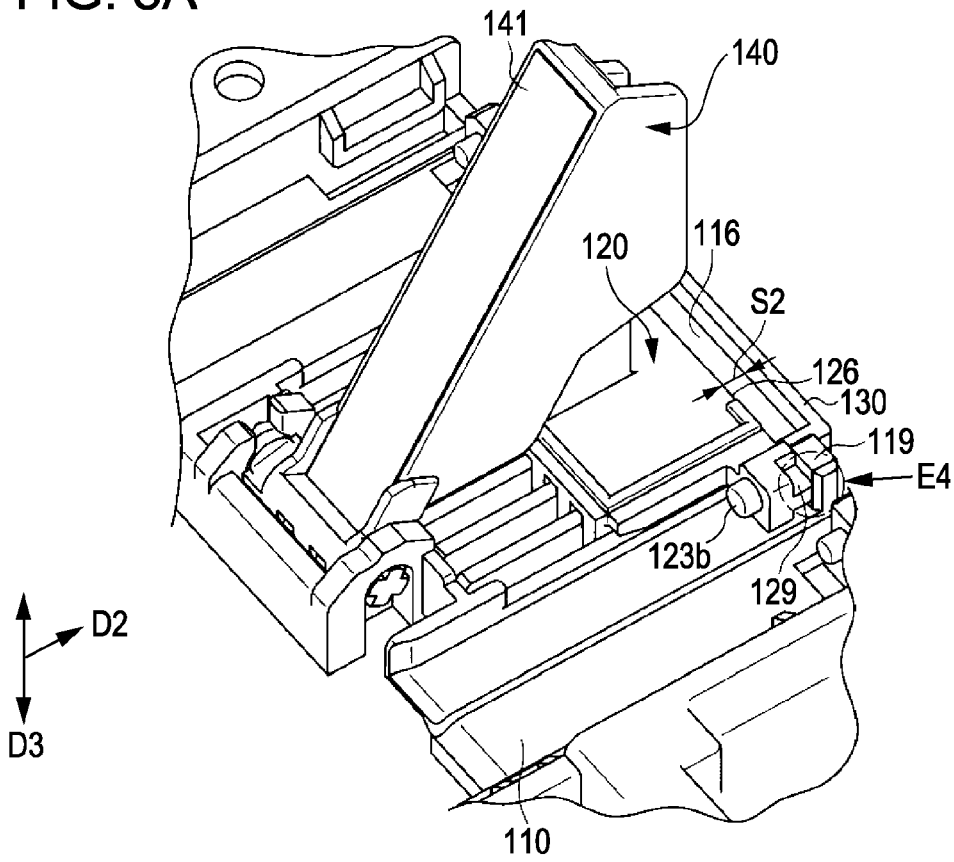
FIG. 8A is a perspective view of the damper member in the embodiment that illustrates a space, formed at the releasing position, in which viscous grease is stored.
Figure 8B:
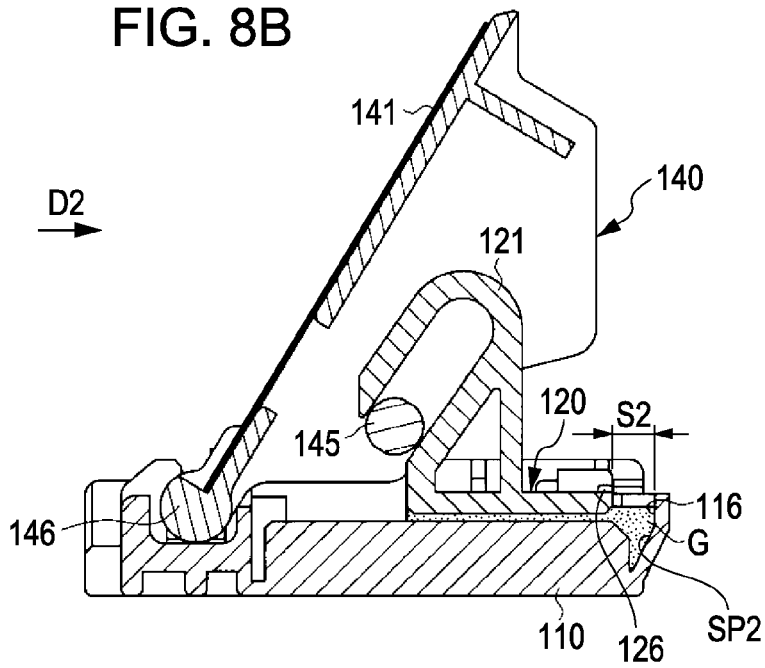
FIG. 8B is a cross sectional view of the damper member.

FIG. 7A is a perspective view of the damper member 100 when the slider 120 is at the first position, that is, the stopper 140 is at the restricting position at which the stopper 140 restricts the movement of the paper P. FIG. 7B schematically shows the cross section of the damper member 100 with the slider 120 at the first position, when viewed in the width direction D4. FIG. 8A is a perspective view of the damper member 100 when the slider 120 is at the second position, that is, the stopper 140 is at the releasing position at which the stopper 140 releases the restriction on the movement of the paper P. FIG. 8B schematically shows the cross section of the damper member 100 with the slider 120 at the second position, when viewed in the width direction D4.

As shown in FIG. 7A, when the stopper 140 is at the restricting position, at which the stopper 140 restricts the movement of the paper P, the slider 120 is located at the first position. At that time, if the slider 120 has been located at the second position corresponding to the previous releasing position, for example, the slider 120 is moved in the removal direction D1 so that movement in both the insertion direction D2 and removal direction D1 is restricted, by which the slider 120 is located at the first position. That is, when the slider 120 is at the first position, its movement in the insertion direction D2 is restricted by the opening circumference 135 of the slider cassette 130, as described above. Movement in the removal direction D1 is restricted when the counter abutting section 128 formed on the slider 120 comes into contact with the abutting section 118 formed on the base 110 as indicated by the arrow E3 in the drawing. The abutting section 118 and counter abutting section 128 are formed at positions at which they do not overlap the first sliding surface SP (second sliding surface TP) in a plane, in plan view in the thickness direction D3.

With the slider 120 located at the first position, the base 110 in the embodiment is shaped so as to have a wall 114 with a clearance S1 between the wall 114 and an end 124 of the slider 120 in the removal direction, as shown in FIG. 7A. As a result, a clearance area SP1 for storing the viscous grease G is formed, due to the clearance S1, in front of the slider 120 in the movement direction (removal direction D1), as shown in FIG. 7B. The clearance area SP1 has a spatial area enough to store at least a surplus of the viscous grease G (a surplus amount of grease GY).

As shown in FIG. 8A, when the stopper 140 is at the position at which the stopper 140 releases the restriction on the movement of the paper P, the slider 120 is located at the second position. At that time, the slider 120 moves in the insertion direction D2 and then its movement in the insertion direction D2 is restricted, by which the slider 120 is located at the second position. That is, when the slider 120 is at the second position, its movement in the insertion direction D2 is restricted when the counter abutting section 129 formed on the slider 120 comes into contact with the abutting section 119 formed on the base 110 as indicated by the arrow E4 in the drawing. The abutting section 119 and counter abutting section 129 are formed at positions at which they do not overlap the first sliding surface SP (second sliding surface TP) in a plane, in plan view in the thickness direction D3.

With the slider 120 located at the second position, the base 110 in the embodiment is shaped so as to have a wall 116 with a clearance S2 between the wall 116 and an end 126 of the slider 120 in the insertion direction, as shown in FIG. 8A. As a result, a clearance area SP2 for storing the viscous grease G is formed, due to the clearance S2, in front of the slider 120 in the movement direction (insertion direction D2), as shown in FIG. 8B. The clearance area SP2 has a spatial area enough to store at least a surplus of the viscous grease G (a surplus amount of grease GY).

According to the embodiment described above, the advantages described below can be obtained.

(1) Since the viscous grease raked out of the second sliding surface TP toward the front in the sliding direction is stored in the clearance areas SP1 and SP2 formed between the base 110 and the front end of the slider 120 in the sliding direction, the viscous grease is held in the vicinity of the second sliding surface TP. This suppresses the raked-out viscous grease from adhering to other portions and being thereby lost, so the viscous material can be stably held between the first sliding surface SP and the second sliding surface TP, suppressing a change in damper force. It is also suppressed that the damper member 100 is dirtied by the raked-out viscous grease that would otherwise adhere to other portions.

(2) A surplus over the amount of viscous grease that can be held between the first sliding surface SP and the second sliding surface TP can be completely stored in the clearance area SP1 formed at the front end of the slider 120 in the sliding direction. Therefore, the viscous grease is held in the vicinity of the second sliding surface TP and, in principle, the viscous grease does not adhere to other portions, so the viscous grease can be stably held between the first sliding surface SP and the second sliding surface TP. As a result, a change in dumper force can be suppressed and it is also suppressed that the damper member 100 is dirtied by the raked-out viscous grease.

(3) Since the second sliding surface TP has a concave and convex shape, the total area of the second sliding surface TP can be enlarged. Therefore, even if the allowable area of the second sliding surface TP is small in plan view, the second sliding surface can face the first sliding surface SP in a wide area through the viscous grease, enabling the damper force to be increased. The total area can also be adjusted on the basis of the concave and convex shape to be formed, so the damper force of the damper member 100 can also be set to a desired value.

(4) A shape for the positioning of the slider 120 is formed at least a position apart from the second sliding surface TP in a plane, the positioning section is formed in an area other than the second sliding surface TP. Therefore, the concave and convex shape of the second sliding surface TP can be formed so that the shape does not change while the slider 120 is sliding. Accordingly, a change in dumper force can be suppressed. Since the positioning section is formed at a position apart from the second sliding surface TP, it is also suppressed that the raked-out viscous grease adheres to the positioning section, that is, another portion.

(5) Since the clearance area SP1, in which the viscous grease is stored, is formed at the end, of the second sliding surface TP, close to the paper P, it is suppressed that the viscous grease raked out of the second sliding surface TP extends beyond the second sliding surface TP adheres to the paper P.

The above embodiment may be changed to another embodiment as described below.

The positioning section (opening circumference 135 and abutting sections 118 and 119) in the above embodiment, which positions the slider 120 at the first position and second position, may be formed adjacent to the first sliding surface SP. In the damper member 100, it may not be possible because of, for example, a restriction on space, to form the positioning section so that it does not overlap the first sliding surface SP in a plane. In this case, the positioning section may be formed so as to be adjacent to the first sliding surface SP as in a variation described below.

Figure 9:
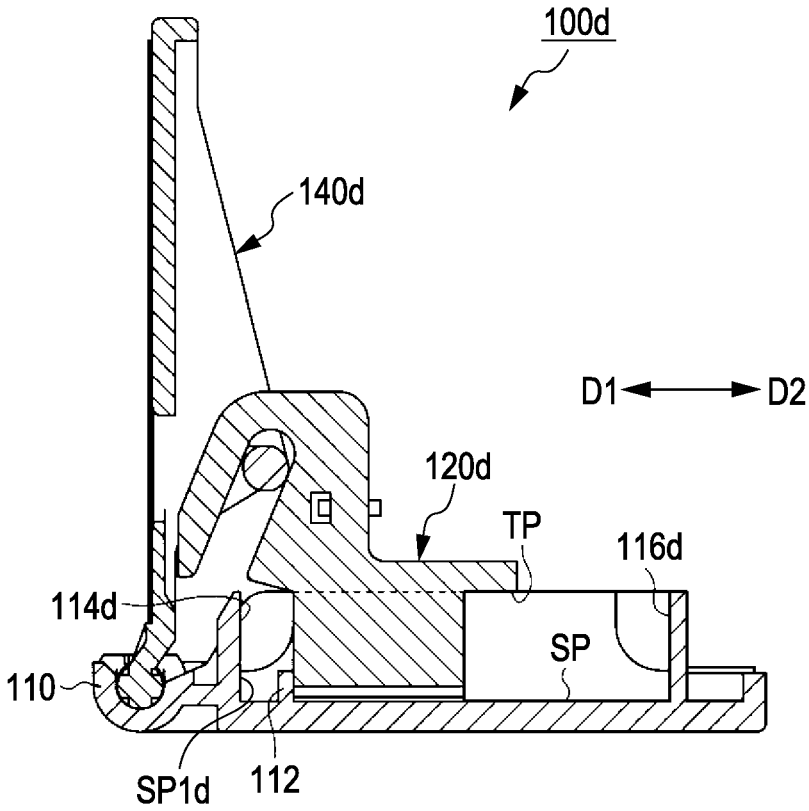
FIG. 9 is a cross sectional view of a damper member in a variation.

A variation will be descried with reference to FIG. 9. FIG. 9, corresponding to FIG. 7B, is a cross sectional view of a damper member 100*d* in which a stopper 140*d* is at the restricting position and thereby the slider 120*d* is at the restricting position. The slider cassette 130 is omitted in the drawing.

As shown in FIG. 9, the base 110 includes an engaging section 112, having a rib shape, adjacent to the first sliding surface SP; the engaging section 112 extrudes from the plane of the first sliding surface SP in the thickness direction D3 at the end of the first sliding surface SP in the removal direction D1 and has a predetermined length in the width direction D4. When the slider 120*d* engages the engaging section 112, the movement of the slider 120*d* in the removal direction D1 is restricted and the slider 120*d* is located at the first position. In this positioning state, a wall 114*d*, which is part of the base 110, is disposed with a space at the front of the slider 120*d* in the removal direction D1. That is, a clearance area SP1*d* is formed between the wall 114*d* and the end of the slider 120*d* in the removal direction D1.

Accordingly, the viscous grease raked out in the removal direction D1 due to the sliding of the slider 120*d* is stored in the clearance area SP1*d*, suppressing the viscous grease from extending to other portions. In particular, since the clearance area SP1*d* is formed when the slider 120*d* is at the first position, that is, the clearance area SP1*d* is formed at the end of the slider 120*d* in the removal direction D1, close to the paper P (not shown), the problem that viscous grease adheres to the paper P can be eliminated.

In this variation, at the releasing position, although explanation will be omitted, a clearance area is not formed between the slider 120*d* and the wall 116*d*, which is part of the base 110, when the slider 120*d* is at the second position. If the distance between the raked-out viscous grease and the paper P is long or viscous grease is less likely to adhere to other portions, a clearance area is not necessary formed as in the above case. Then, the length of the base 110 in the mounting direction is reduced by the length of the clearance, preventing a damper member 100*d* from becoming large. This is also true for the embodiment described above. In this variation as well, at the second position too, a clearance area may be, of course, formed between the base 110 and the end of the slider 120*d* in the insertion direction D2.

Although, in the above embodiment, the second sliding surface has had a so-called comb shape, in which a concave part and a convex part are contiguously repeated in the width direction D4, this is not a limitation; the second sliding surface may have a shape in which a concave part and a convex part that have a sawtooth cross section are contiguously repeated. Alternatively, the second sliding surface may have a flat surface without concave parts and convex parts. In short, any shape that provides a damper function through viscous grease may be used.

Although, in the above embodiment, the first sliding surface SP or second sliding surface TP has been a plane area that is substantially rectangular when viewed in the thickness direction D3, this is not a limitation; the plane area may have a non-rectangular shape such as a circular or triangular shape.

Although, in the above embodiment, the clearance areas SP1 and SP2 each have been capable of storing a surplus amount of viscous grease, they may not necessarily be capable of storing the surplus viscous grease. If, for example, part of the surplus viscous grease is stored in the clearance area SP1 and the remainder is stored in the clearance area SP2, then the clearance areas SP1 and SP2 may have sizes enough to store at least divided amounts of viscous grease. This can suppress adherence of viscous grease.

Although, in the above embodiment, the printer 11 of ink jet type has been used to make a recording unit concrete, other recording units that eject or expel a liquid other than ink may be used. The recording unit can be diverted as one of various recoding units having, for example, a liquid ejecting head that can expel very small droplets. A droplet refers to a liquid expelled from the above recording unit. Droplets include granular droplets, tear-like droplets, and droplets extending like threads. The liquid referred to here may be a material that the recording unit can eject. For example, a material in a liquid-phase state may be used. Other usable liquids include not only liquid materials that are highly viscous or less viscous, sols, gel water, other inorganic solvents, organic solvents, solutions, fluid materials such as liquid resins and liquid metals (molten metal liquids), and liquids present as one state of materials, but also solvents in which functional materials made of solids, such as pigments or metal particles, are solved, dispersed, or mixed. A typical example of a liquid is ink as described in the above embodiment. Inks referred to here include ordinary aqueous inks, oil-based inks, gel inks, hot melt inks, and other types of inks including various liquid components. Specific examples of the recording unit include, for example, recording units that eject a liquid in which electrode materials, color materials, and other materials that are used in the manufacturing of liquid crystal display units, electro-luminescence (EL) display units, surface-emitting display units, and color filters are dispersed or dissolved. Alternatively, the recording unit may be a printer, a micro-dispenser, or the like. One of these units can be applied to the embodiment of the invention.

What is claimed is:

1. A recording unit comprising:

a restricting member, structured so as to be rotatable around an axial portion, that is brought into contact with a target to restrict movement of the target; and a damper member that causes the restricting member to rotate after a delay in time from a restricting position, at which the restricting member restricts the movement of the target, to a releasing position, at which restriction on the movement of the target is released;

wherein the damper member includes:

a viscous material, a first member having a first sliding surface in a direction in which the target moves, and a second member having a second sliding surface, wherein:

the second sliding surface which faces the first sliding surface of the first member with the viscous material being applied therebetween, the second member slides sliding between a first position at which the restricting member is placed at the restricting position and a second position at which the restricting member is placed at the releasing position with the second member engaging the restricting member, and a clearance area for storing the viscous material when at least the second member slides and reaches one of the first position and the second position, wherein the clearance area is formed in the first member to store the viscous material, at a position corresponding to a front end of the second member in a sliding direction thereof.

2. The recording unit according to claim 1, wherein:

an area over which the second sliding surface faces the first sliding face is unchanged while the second member slides between the first position and the second position; and the clearance area has a space enough to store a surplus over an amount by the viscous material is held on the second sliding surface.

3. The recording unit according to claim 1, wherein the second sliding surface has a cross section, intersecting the sliding direction of the second sliding surface, that is shaped by repeating a concave part and a convex part in a direction intersecting the sliding direction.

4. The recording unit according to claim 1, wherein a positioning section that locates the second member at the first position or the second position with respect to the first member is formed in an area other than the first member and the second sliding surface of the second member.

5. The recording unit according to claim 1, wherein:

the second member comes closest to the target when the second member is located at the first position; and the clearance area is formed at the front end of the second sliding surface in the sliding direction in which the second member slides to the first position.

* * * * *